US012796846B2

(12) United States Patent
Brown et al.

(10) Patent No.: US 12,796,846 B2
(45) **Date of Patent: *Nov. 17, 2026**

(54) PILLOW

(71) Applicant: Hit Notions, LLC, Detroit, MI (US)

(72) Inventors: Vita-Anne Brown, Detroit, MI (US); Jason Berke, Bloomfield, MI (US)

(73) Assignee: Hit Notions, LLC, Detroit, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/372,049

(22) Filed: Oct. 28, 2025

(65) Prior Publication Data

US 2026/0053285 A1 Feb. 26, 2026

Related U.S. Application Data

(63) Continuation of application No. 17/129,360, filed on Dec. 21, 2020, now Pat. No. 12,484,721, which is a continuation of application No. 29/717,095, filed on Dec. 13, 2019, now Pat. No. Des. 949,600, which is a continuation of application No. 29/622,761, filed on Oct. 19, 2017, now Pat. No. Des. 875,432, and a (Continued)

(51) Int. Cl.
*A47G 9/10* (2006.01)

(52) U.S. Cl.
CPC ..... *A47G 9/1072* (2013.01); *A47G 9/1081* (2013.01)

(58) Field of Classification Search
CPC ..... A47G 9/10; A47G 9/1072; A47G 9/1045; A47G 9/0253; A47G 2009/1018; A47C 7/383
See application file for complete search history.

(56) References Cited

U.S. PATENT DOCUMENTS

| | | | |
|---|---|---|---|
| 200,504 | A | 2/1878 | Buell |
| 2,489,693 | A | 11/1949 | Williams |
| 2,623,574 | A | 12/1952 | Damsch |

(Continued)

FOREIGN PATENT DOCUMENTS

| | | | |
|---|---|---|---|
| CN | 201295056 | Y | 8/2009 |
| FR | 1196483 | A | 11/1959 |

(Continued)

OTHER PUBLICATIONS https://www.amazon.com/Cheer-Collection-Foarn-Filled-Detachable-Washable/dp/B074F4TD61/ref=cm_cr_arp_d_product_top?ie=UTF8&th=1 accessed Jan. 27, 2021 (Year: 2017).

(Continued)

*Primary Examiner* — Eric J Kurilla
(74) *Attorney, Agent, or Firm* — Howard & Howard Attorneys PLLC

(57) ABSTRACT

A pillow for ergonomically supporting a user includes a central supporting pillow having at least two arm support members extending from the central supporting pillow, an adjustable neck support member being cylindrical in shape and having an outer surface, and a bungee cord attached to the neck support member and the central support pillow, wherein the neck support member is freely adjustable and detachably attached using the bungee cord, the bungee cord having one end attached to a top surface of the central supporting pillow and another end attached to the outer surface of the adjustable neck support member to ergonomically support a back and a neck of the user.

29 Claims, 17 Drawing Sheets

Related U.S. Application Data continuation-in-part of application No. 15/849,702, filed on Dec. 21, 2017.

(56) References Cited

U.S. PATENT DOCUMENTS

| | | | |
|---|---|---|---|
| 2,708,475 | A | 5/1955 | Krewson |
| 3,137,012 | A | 6/1964 | Halterman |
| 3,195,953 | A | 7/1965 | Zacks |
| 3,235,892 | A | 2/1966 | Emery |
| 3,273,174 | A | 9/1966 | Genaro |
| 3,293,669 | A | 12/1966 | Emery |
| 3,840,916 | A | 10/1974 | Jennings |
| 4,197,604 | A | 4/1980 | Nakamura |
| 4,206,945 | A | 6/1980 | Kifferstein |
| 4,853,275 | A | 8/1989 | Tracy et al. |
| 4,889,388 | A | 12/1989 | Hime |
| D305,288 | S | 1/1990 | Eldridge |
| 5,115,529 | A | 5/1992 | White |
| 5,423,098 | A | 6/1995 | Swezey |
| 5,425,567 | A | 6/1995 | Albecker, III |
| 5,515,563 | A | 5/1996 | Chao |
| D373,275 | S | 9/1996 | Bell |
| D376,503 | S | 12/1996 | Petersson |
| 5,581,833 | A | 12/1996 | Zenoff |
| D382,164 | S | 8/1997 | Hays |
| 5,895,365 | A | 4/1999 | Tomlinson |
| 5,964,504 | A | 10/1999 | Hogan et al. |
| D427,833 | S | 7/2000 | Robinson |
| 6,126,237 | A | 10/2000 | Ritterhouse |
| 6,357,061 | B1 | 3/2002 | Gonzalez |
| 6,434,769 | B1 | 8/2002 | Koenig |
| 6,435,617 | B1 | 8/2002 | McNair |
| 6,669,300 | B1 | 12/2003 | Lee |
| 6,748,615 | B1 | 6/2004 | Tiedemann |
| 6,782,572 | B1 | 8/2004 | Jones |
| 6,814,709 | B2 | 11/2004 | Schwartz et al. |
| 7,086,105 | B1 | 8/2006 | Gottlieb |
| 7,284,290 | B1 | 10/2007 | Swezey et al. |
| 7,313,836 | B1 | 1/2008 | Swezey et al. |
| 7,328,470 | B2 | 2/2008 | Harris et al. |
| 7,346,948 | B1 | 3/2008 | Swezey et al. |
| 7,412,738 | B2 | 8/2008 | Chaffee |
| 7,547,071 | B2 | 6/2009 | Huffman |
| 8,181,599 | B1 | 5/2012 | Jeffers |
| 8,448,275 | B1 | 5/2013 | Leach |
| 8,459,737 | B2 | 6/2013 | Brotsch |
| D747,612 | S | 1/2016 | Jensen |
| 9,693,638 | B1 | 7/2017 | Leach |
| D875,432 | S | 2/2020 | Brown |
| D892,518 | S | 8/2020 | Zhao |
| 10,869,556 | B2 | 12/2020 | Alletto, Jr. |
| 11,039,699 | B1 | 6/2021 | Leach |
| D948,060 | S | 4/2022 | Szparski |
| 12,484,721 | B2 * | 12/2025 | Brown ..... A47G 9/1081 |
| 2001/0052153 | A1 | 12/2001 | Schwartz et al. |
| 2002/0063453 | A1 | 5/2002 | Terry |
| 2002/0163240 | A1 | 11/2002 | Cheng |
| 2003/0038521 | A1 | 2/2003 | Johnson |
| 2003/0200611 | A1 | 10/2003 | Chaffee |
| 2006/0214476 | A1 | 9/2006 | Rojas |
| 2007/0052274 | A1 | 3/2007 | Morphew et al. |
| 2007/0271703 | A1 | 11/2007 | Matthews et al. |
| 2008/0164734 | A1 | 7/2008 | Nile et al. |
| 2009/0151078 | A1 | 6/2009 | Soehner |
| 2010/0242178 | A1 | 9/2010 | Goetting |
| 2011/0031799 | A1 | 2/2011 | DeJoode |
| 2013/0119716 | A1 | 5/2013 | Stronconi |
| 2013/0139320 | A1 | 6/2013 | Tzameret |
| 2014/0191544 | A1 | 7/2014 | Comber |
| 2015/0074953 | A1 | 3/2015 | Dershem |
| 2015/0265062 | A1 | 9/2015 | Blyberg |
| 2017/0164754 | A1 | 6/2017 | Alletto, Jr. |
| 2017/0332802 | A1 | 11/2017 | Stern |
| 2019/0191900 | A1 | 6/2019 | Brown |
| 2020/0022510 | A1 | 1/2020 | Shokrian |
| 2021/0186238 | A1 | 6/2021 | Kilo |

FOREIGN PATENT DOCUMENTS

| | | | |
|---|---|---|---|
| FR | 2 336 105 | A1 | 7/1977 |
| FR | 2 401 641 | A1 | 3/1979 |
| FR | 2576500 | A3 | 8/1986 |
| GB | 333738 | A | 8/1930 |
| GB | 1277861 | A | 6/1972 |
| JP | 3080745 | U | 10/2001 |
| WO | 96/28069 | A1 | 9/1996 |
| WO | 2012078596 | A2 | 6/2012 |
| WO | 2021/174296 | A1 | 9/2021 |

OTHER PUBLICATIONS

Alegter Reading and Bed Rest Pillow with Support Arms (on-line), dated Dec. 16, 2020. Retrieved from Internet Dec. 20, 2021, URL: https://www.arnazon.com/Alegter-Reading-Support-Pregnancy-Watching/dp/B08QR9HD54 (7 pages) (Year: 2020).

Alwyn Home Grasmere 24 Backrest Pillow Cover and Insert and Reviews (on-line), dated Jul. 5, 2018. Retreived from Internet Dec. 20, 2021, URL: https://www.wayfair.com/decor-pillows/pdp/alwyn-home-grasmere-24-backrest-pillow-cover-insert-w005160667.html (3 pages) (Year: 2018).

Cheer Collection Large TV and Reading Pillow with Bolster (on-line), no date available. Retrieved from Internet Dec. 20, 2021, URL: https://www.macys.com/shop/productilarge-tv-reading-pillow-with-bolster?ID=11696186&CategoryID=75798&swatchColor=Purple (2 pages).

Large Backrest Reading Pillow With Arm Pockets Ultimate Memory Foam Husband Pillow (on-line), no date available. Retrieved from Internet Dec. 20, 2021, URL: https://www.alibaba.com/product-detail/Large-Backrest-Reading-Pillow-with-Arm_62136213868.html (2 pages).

amazon.com/Husband-Pillow-detachable-removable-adjustable/dp/BQ73WKS6XH/?TH=1 (7pages).

Screenshots of an Amazon Manage Orders Listing (see last page) showing a listing for ASIN B073WKS6XH of a Husband Pillow—Big Bedrest Reading & Support Bed Backrest with Arms Black—Premium Shredded Memory Foam with Detachable Neck Roll Pillow—Bed Rest as being on-sale. The order has the Buyer name: Chad and a date of Jul. 21, 2017, at 7:14 PM PDT, showing that ASIN B073WKS6XH was on-sale and posted as a published publication at least before the date of Jul. 21, 2017, in order to allow the Buyer to order. The screenshots were accessed on May.

Screenshots from Amazon of ASIN B073WKS6XH of a Husband Pillow XXL Black Backrest with Arms—Adult Reading Pillow with Shredded Memory Foam, Ultra-Comfy Removable Microplush Cover & Detachable Neck Roll—Unmatched Support Bed Rest Sit Up Pillow that was obtained via the Internet and shows evidence of on-sale and publication of the husband pillow before Jul. 31, 2017. The screenshots were accessed on May 9, 2022.

* cited by examiner

PILLOW

CROSS-REFERENCE TO RELATED APPLICATIONS

The present application is a continuation application of U.S. Ser. No. 17/129,360, filed Dec. 21, 2020, which is a continuation of U.S. Ser. No. 29/717,095, filed Dec. 13, 2019 (now U.S. Design Pat. No. D949,600, issued Apr. 26, 2022), which is a continuation application of U.S. Ser. No. 29/622,761, filed Oct. 19, 2017 (now U.S. Design Pat. No. D875,432, issued Feb. 18, 2020), and is a continuation-in-part application of U.S. patent application Ser. No. 15/849,702, filed Dec. 21, 2017, the entire disclosures of which are hereby incorporated by reference in its entirety and for all purposes.

TECHNICAL FIELD OF THE INVENTION

The present invention generally relates to pillows. More particularly, the present invention, disclosed herein, relates to a pillow for ergonomically supporting a user.

BACKGROUND OF THE INVENTION

Pillows have been used since ancient times to improve comfort of individuals while sleeping. Pillows have also addressed the problem of recurring back aches, shoulder pains, and neck aches by improving posture while sleeping. Over the years, pillows have been used for both decorative and orthopedic purposes. For instance, threw pillows are used to beautify or improve the aesthetics of the living room or the bedroom. Alternately, lumbar pillows are designed to support the inward curve of the lower back of an individual thereby alleviating pressure on the lower back. Support pillows, on the other hand, are pillows that help position an individual erect while lying on the floor or on a bed for reading or watching television. As such, support pillows are also termed as "reading pillows".

Typically, support pillows are designed to support the lower to mid spinal area and the arms of an individual. Existing support pillows lack the vertical size required to support the shoulder or neck areas of a user. Additionally, existing support pillows lack a headrest or neck support which provides support to the neck area of the user. A pillow which provides ample support to both the spinal and neck regions of a user simultaneously, is therefore required. Furthermore, it is highly advantageous to a user for the headrest or neck support to be adjustable and removable. A pillow, which has, an adjustable headrest or neck support that is also removable, is required.

Hence, there is a long felt but unresolved need for a pillow, which provides ample support to both the spinal and neck regions of a user simultaneously. Furthermore, there is a need for a pillow, which has an adjustable headrest or neck support that is also removable.

SUMMARY OF THE INVENTION

This summary is provided to introduce a selection of concepts in a simplified form that are further disclosed in the detailed description of the present invention. This summary is not intended to identify key or essential inventive concepts of the claimed subject matter, nor is it intended to determine the scope of the claimed subject matter.

The present invention, disclosed herein, addresses the above-mentioned need for a pillow, which provides ample support to both the spinal and neck regions of a user simultaneously. Furthermore, there is a need for a pillow, which has an adjustable headrest or neck support that is also removable.

It is an object of the present invention to provide a pillow that can support the spinal and neck regions of a user. Further, it is an object of the present invention to provide a pillow having an adjustable and removable headrest or neck support. Moreover, it is an object of the present invention to provide a pillow having multiple storage compartments for storing one or more objects.

The present invention provides a pillow for ergonomically supporting a user including a central supporting pillow having at least two arm support members extending from the central supporting pillow. The pillow also includes an adjustable neck support member being cylindrical in shape and having an outer surface, and a bungee cord attached to the neck support member and the central support pillow. The neck support member is freely adjustable and detachably attached using the bungee cord. The bungee cord has one end attached to a top surface of the central supporting pillow and another end attached to the outer surface of the adjustable neck support member to ergonomically support a back and a neck of the user.

The present invention also provides a pillow for ergonomically supporting a user including a central supporting pillow having at least two arm support members extending from the central supporting pillow. The pillow also includes an adjustable neck support member being cylindrical in shape and having an outer surface, and a bungee cord attached to the neck support member and the central support pillow. The neck support member is freely adjustable and detachably attached using the bungee cord. The bungee cord has one end attached to a top surface of the central supporting pillow and another end attached to the cylindrical portion of the adjustable neck support member to ergonomically support a back and a neck of the user.

The present invention further provides a pillow for ergonomically supporting a user including a central support pillow, at least two arm support members, and a neck support member. The central support pillow includes a front surface, a rear surface, a top surface, and a bottom surface. The front surface of the central support pillow is configured to contact a back of the user and conform to the back of the user. The two arm support members extend outward from the front surface of the central support pillow and the at least two arm support members are positioned proximal to the bottom surface of the central support pillow to support arms of the user. The neck support member has a cylindrical portion and opposing end portions and an elongated attachment member having one end attached to the cylindrical portion of the neck support member and another end detachably attached to the top surface of the central support pillow. The neck support member is freely adjustable and detachably attached using the attachment member relative to a top surface of the central supporting pillow to ergonomically support a neck of the user.

In an embodiment, the pillow, disclosed herein, for ergonomically supporting a user includes a central support pillow, at least two arm support members, and a neck support member. The central support pillow includes a front surface, a rear surface, a top surface, and a bottom surface. The front surface of the central support pillow is configured to contact the back of the user and conform to the back of the user. The arm support members extend outward from the front surface of the central support pillow. Additionally, the arm support members are positioned proximal to the bottom surface of the central support pillow to support arms of the user. A plurality of storage compartments is configured on the at least two arm support members and the central support pillow for storing one or more objects. The neck support member is detachably attached to a top surface of the central support pillow to support a neck of the user. The central support pillow, the at least two arm support members, and the neck support member ergonomically support the back, the neck, and the arms of the user respectively.

BRIEF DESCRIPTION OF THE FIGURES

The foregoing summary, as well as the following detailed description of the present invention, is better understood when read in conjunctions with the appended drawings. For the purpose of illustrating; the present invention, exemplary constructions of the present invention are shown in the drawings. However, the present invention is not limited to the specific methods, components, and structures disclosed herein. The description of a method step, a component, or a structure referenced by a numeral in a drawing is applicable to the description of that method step, component, or structure shown by that same numeral in any subsequent drawing herein.

DETAILED DESCRIPTION OF THE EMBODIMENTS

FIGS. 1-8 exemplarily illustrate an ornamental design for a pillow, according to an embodiment of the present invention.

Figure 1:
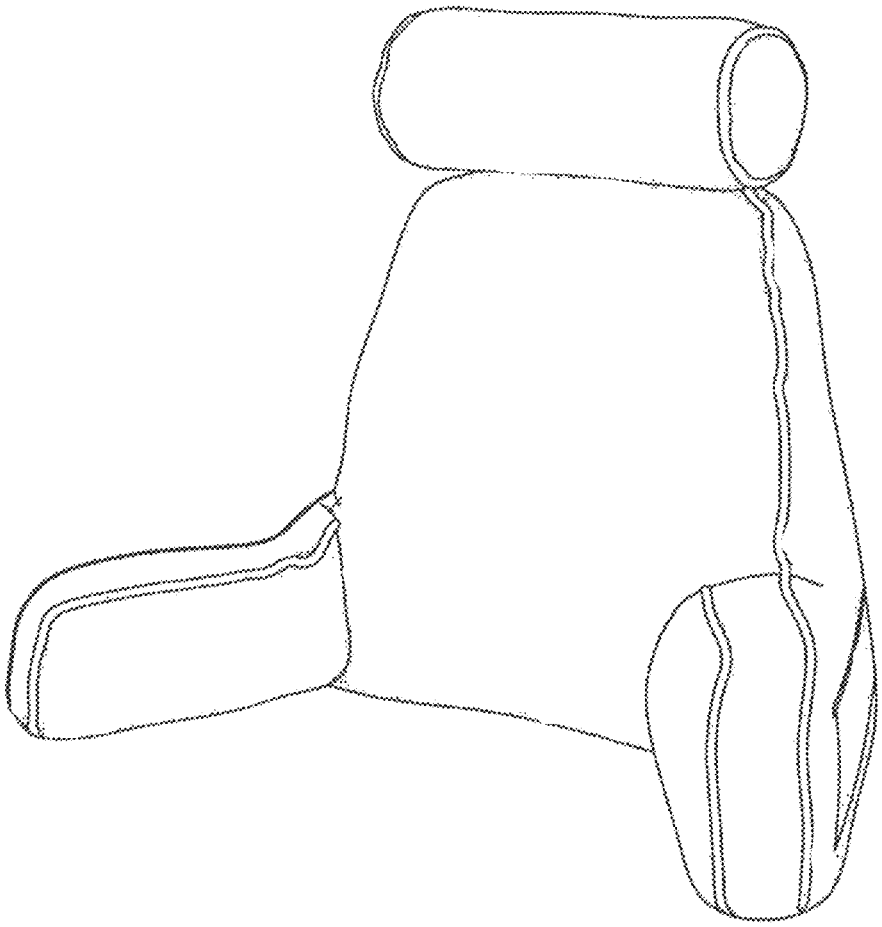
FIG. 1 is a top, front, right perspective view of a pillow, showing a new design, according to an embodiment of the present invention.
Figure 2:
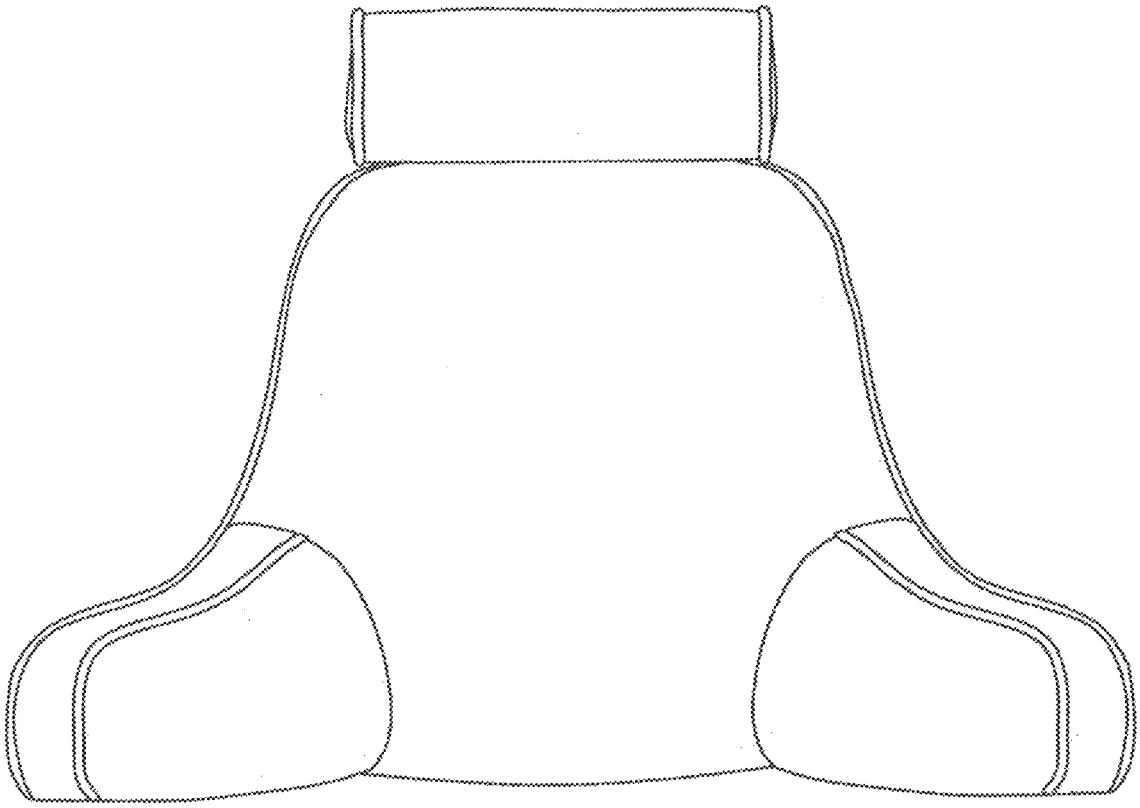
FIG. 2 is a front view thereof.
Figure 3:
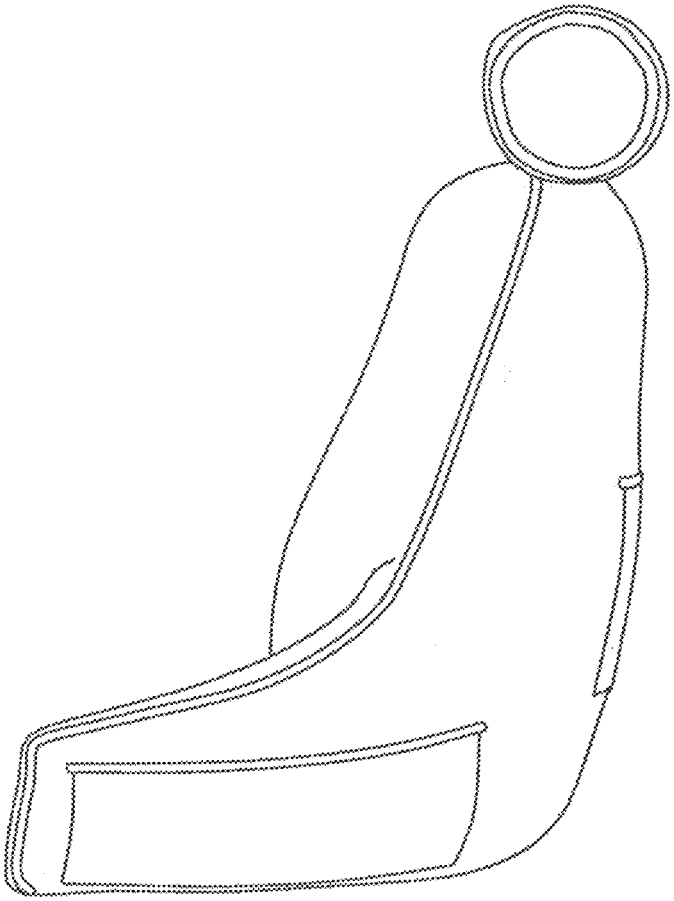
FIG. 3 is a right side view thereof.
Figure 4:
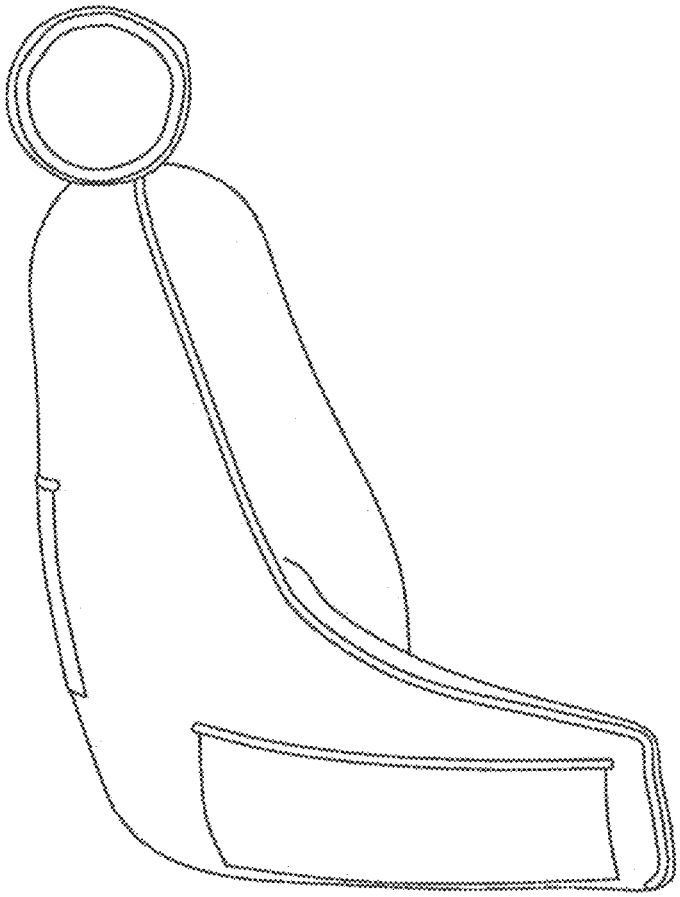
FIG. 4 is a left side view thereof.
Figure 5:
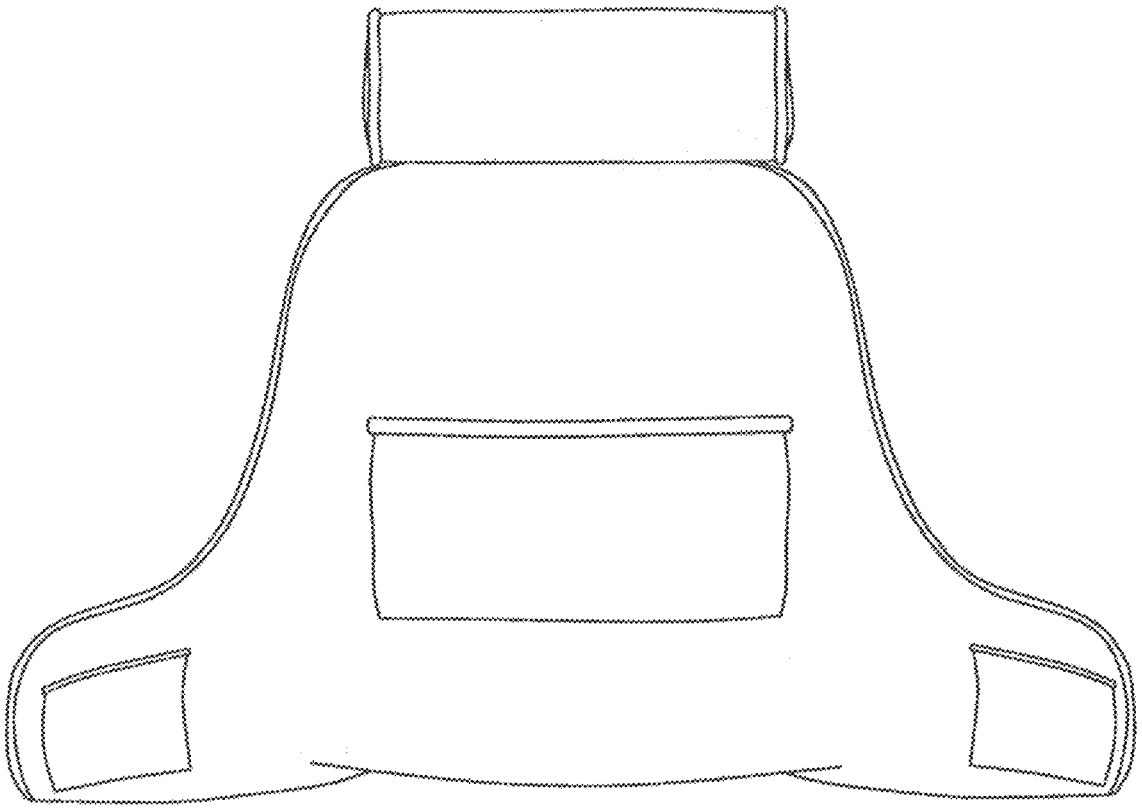
FIG. 5 is a rear view thereof.
Figure 6:
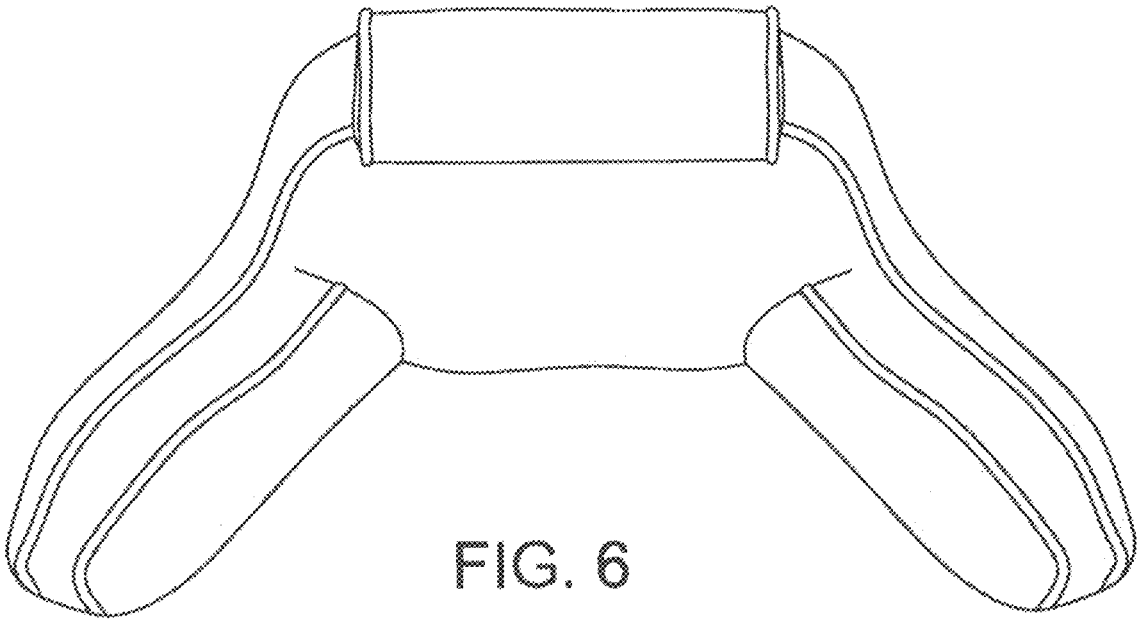
FIG. 6 is a top view thereof.
Figure 7:
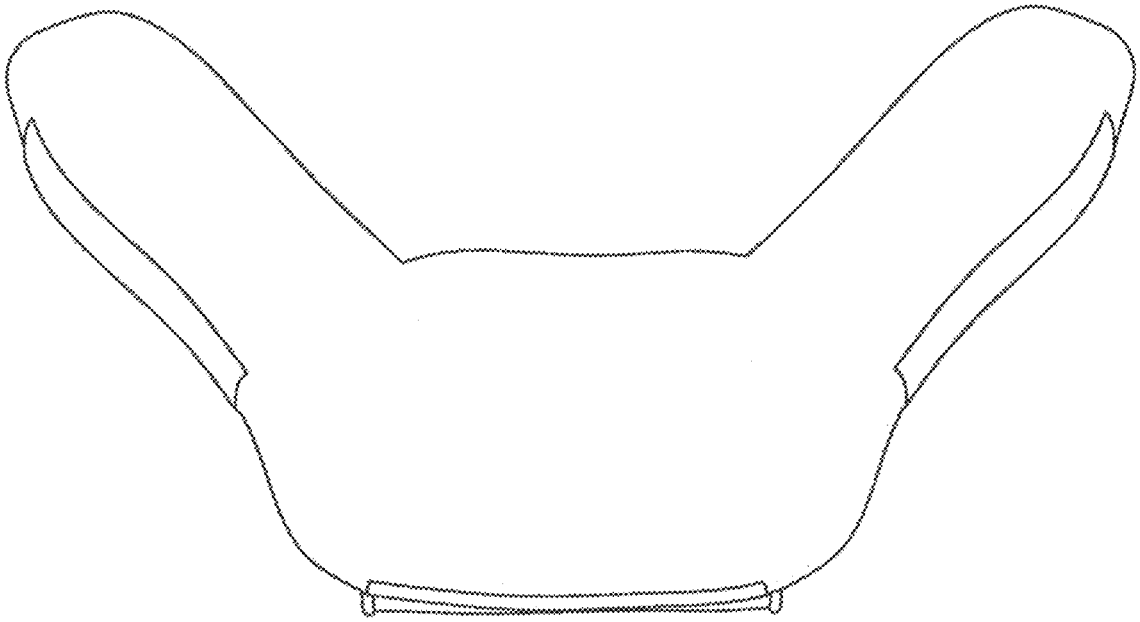
FIG. 7 is a bottom view thereof.
Figure 8:
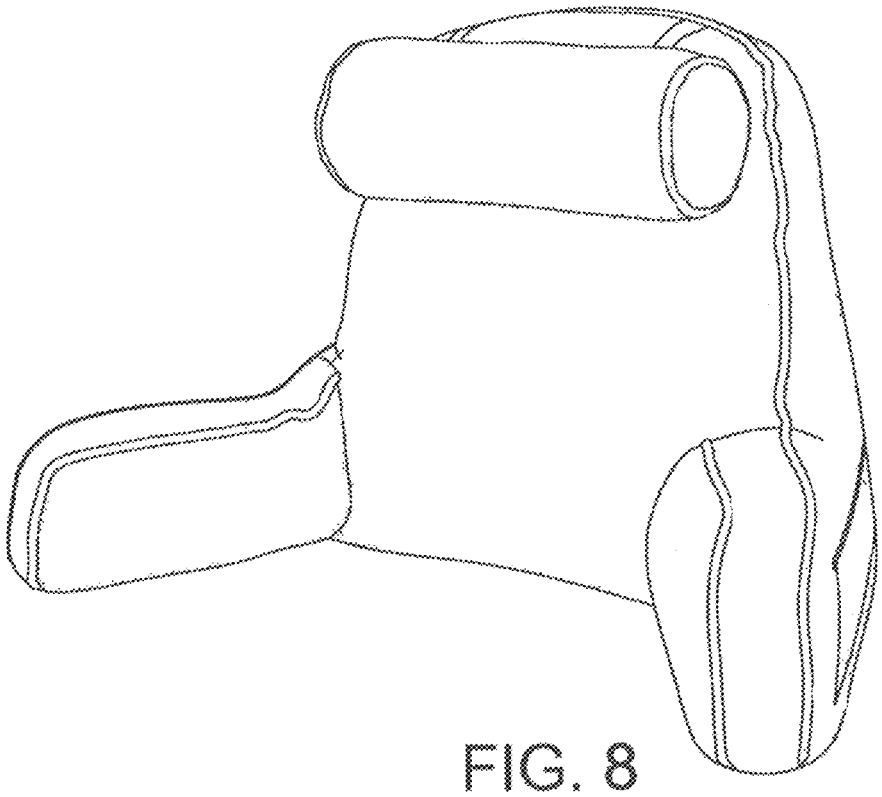
FIG. 8 is a top, front right perspective view thereof with a head pillow portion or neck support member positioned downwardly from that shown in FIG. 1.
Figure 9:
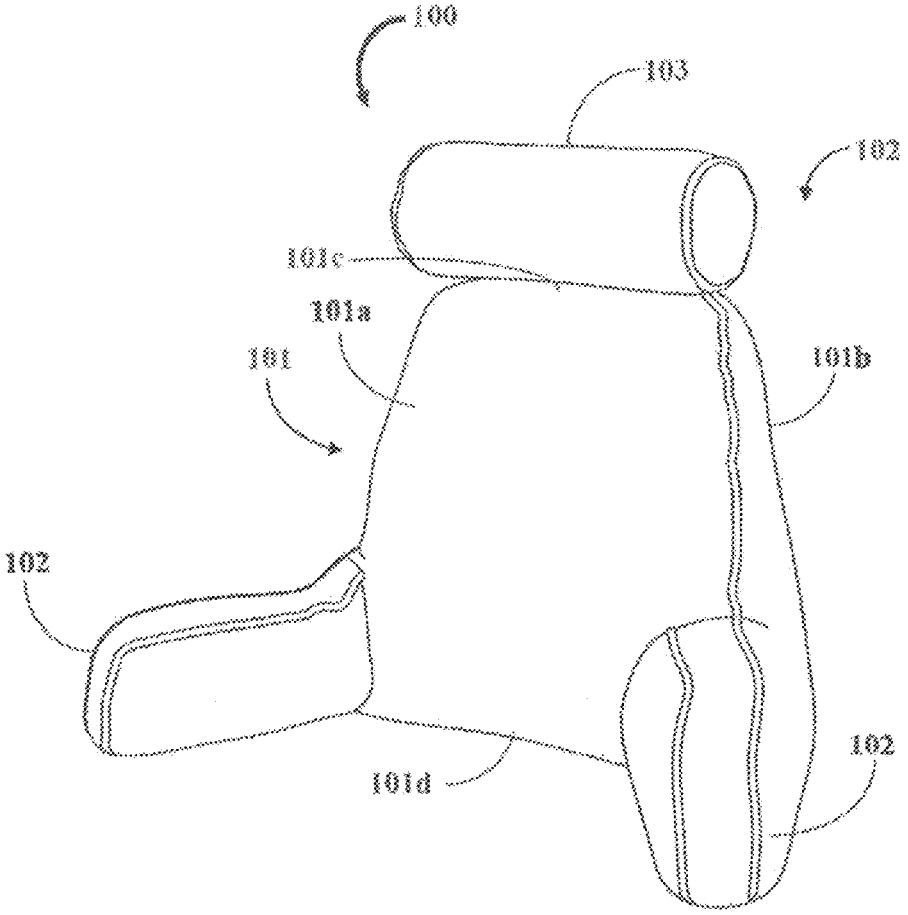
FIG. 9 exemplarily illustrates a front perspective view of a pillow, according to an embodiment of the present invention.
Figure 10:
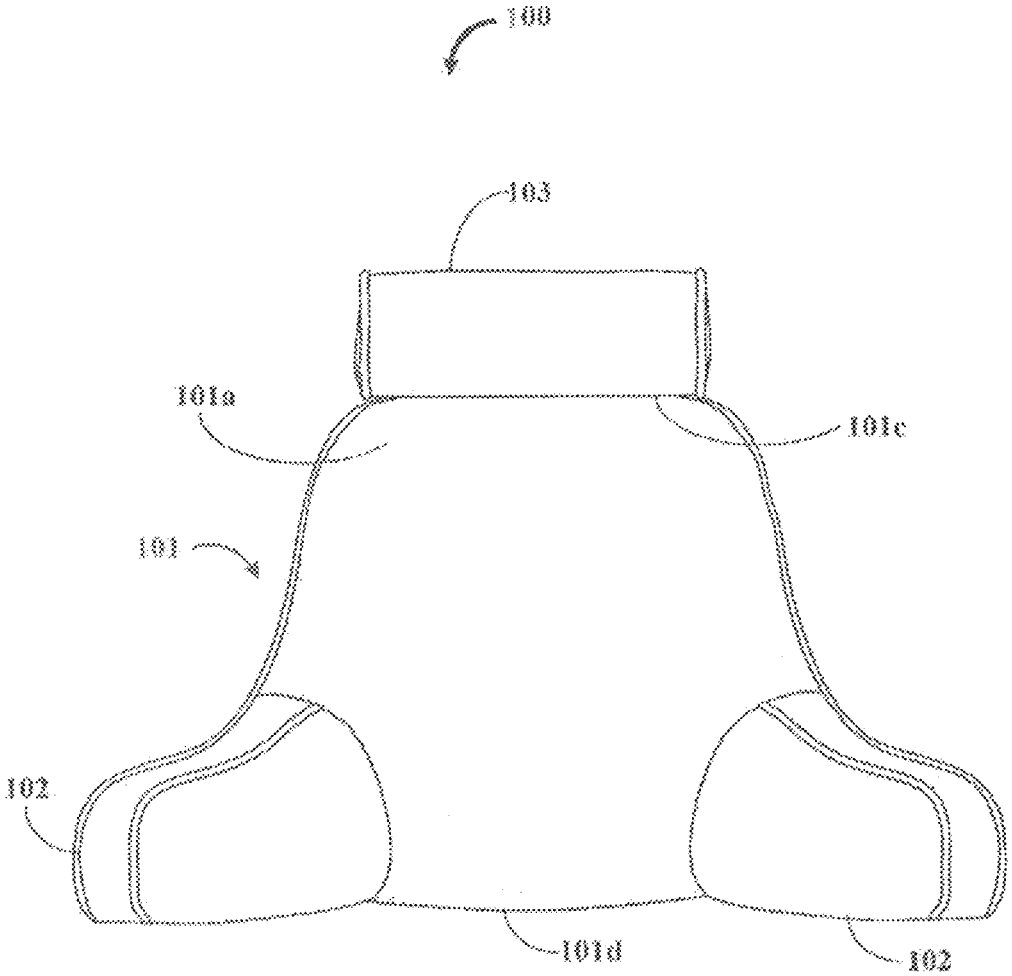
FIG. 10 exemplarily illustrates a front elevation view of the pillow of FIG. 9.

FIG. 9 exemplarily illustrates a front perspective view of a pillow 100, according to an embodiment of the present invention. FIG. 10 exemplarily illustrates a front elevation view of the pillow 100. The pillow 100 for ergonomically supporting a user includes a central support pillow 101, at least two arm support members 102, and a neck support member 103. The central support pillow 101 includes a front surface 101*a*, a rear surface 101*b*, a top surface 101*c*, and a bottom surface 101*d*. In an embodiment the exterior of the central support pillow 101, the arm support members 102, and the neck support member 103 is made of a natural or synthetic fiber, for example, polyester, rubber, cotton, etc. Further, the interior of the central support pillow 101, the arm support members 102, and the neck support member 103 are made of filler materials, for example, foam, cotton, poly-fill, memory foam, Styrofoam beads, etc. The filler materials may also include a combination of gases and foam or only include gases. In one embodiment, the neck support member 103 is generally cylindrical in shape. In one embodiment, the neck support member 103 has a cylindrical portion 103*a* extending axially and end portions 103*b* at each axial end of the cylindrical portion 103*a*. The neck support member 103 also has an outer surface 103*c* and a zip fastener or zipper 103*d* (FIG. 16) along the outer surface 103*c* to allow the filler materials to be removed from an interior thereof. The central support pillow 101 and the arm support members 102 are a single compact unit and the external fiber provides an airtight seal to the filler material contained within.

The front surface 101*a* of the central support pillow 101 is configured to contact the back of the user and conform to the back of the user. The at least two support members 102 extend outward from the front surface 101*a* of the central support pillow 101. In an embodiment, the at least two arm support members 102 are positioned proximal to the bottom surface 101*d* of the central support pillow 101 to support the arms of the user. A plurality of storage compartments 104 is configured on the at least two arm support members 102 and the central support pillow 101 for storing one or more objects as exemplarily illustrated in FIGS. 11 and 12. The neck support member 103 is detachable attached to a top surface 101*c* of the central support pillow 101 to support a neck of the user. The front surface 101*a* of the central support pillow 101, the at least two arm support members 102, and the neck support member 103 ergonomically support the back, the arms, and the neck of the user respectively to provide a comfortable position when a user is laying down or partially seated. In an embodiment, the arm support members 102 are positioned at an angle, for example, around 90-120 degrees, relative to the central support pillow 101.

Figure 11:
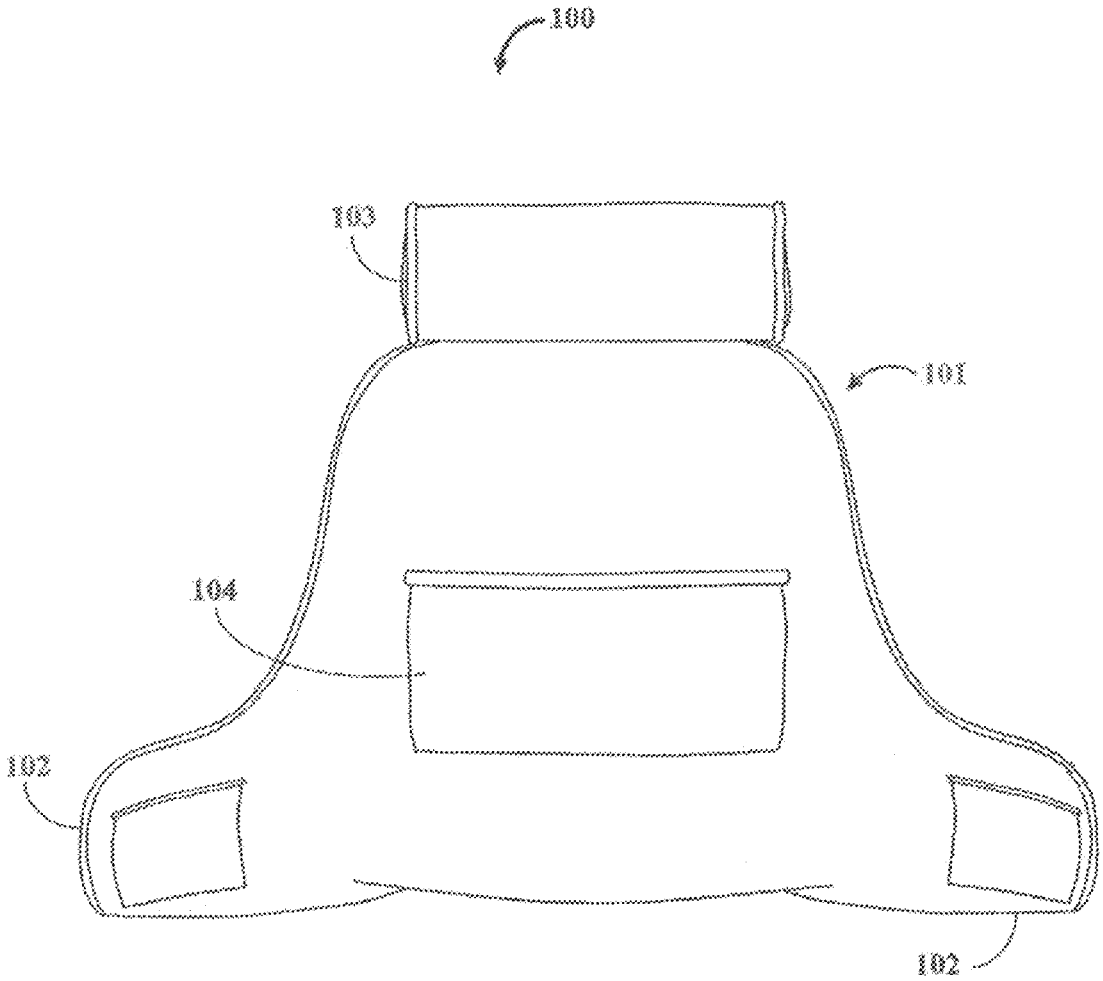
FIG. 11 exemplarily illustrates a rear elevation view of the pillow of FIG. 9.
Figure 12:
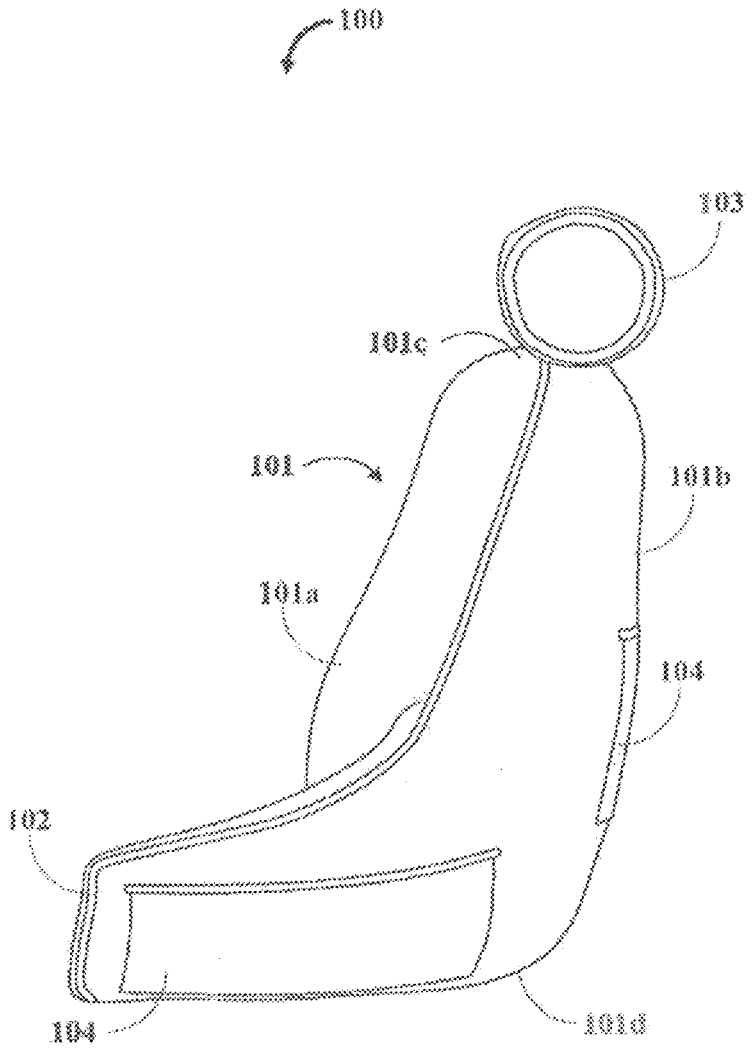
FIG. 12 exemplarily illustrates a right-side elevation view of the pillow of FIG. 9.

FIG. 11 exemplarily illustrates a rear elevation view of the pillow 100. FIG. 12 exemplarily illustrates a right-side elevation view of the pillow 100. In an embodiment, the storage compartments 104 are configured on the rear surface 101*b* of the central support pillow 101 and the outer surfaces of the arm support members 102 as exemplarily illustrated in FIGS. 11 and 12. The storage compartments 104 store one or more objects, for example, headphones, e-book readers, laptops, remotes of nearby appliances, spectacles, etc. The storage compartments 104 may be open pouches or pockets or sealable compartments having zip fasteners to seal the storage compartment 101. The neck support member 103 is detachably attached to the top surface 101*c* of the central support pillow 101. In an embodiment, the neck support member 103 is adjustable and detachably attached using one or more attachment members 104 such as snap fasteners, hook and loop fasteners, bungee cords, or drawstrings. In an embodiment, the attachment members 104 are elongated. In an embodiment, the attachment members 104 are flexible and may be stretchable. The pillow 100 may include a closed loop or handle 105 attached by a suitable mechanism such as stitching to the central support pillow 101. The pillow 100 may entirely be housed within a removable fabric cover that can be washed periodically to prevent dirt from accumulating on the surface of the pillow 100.

Figure 13:
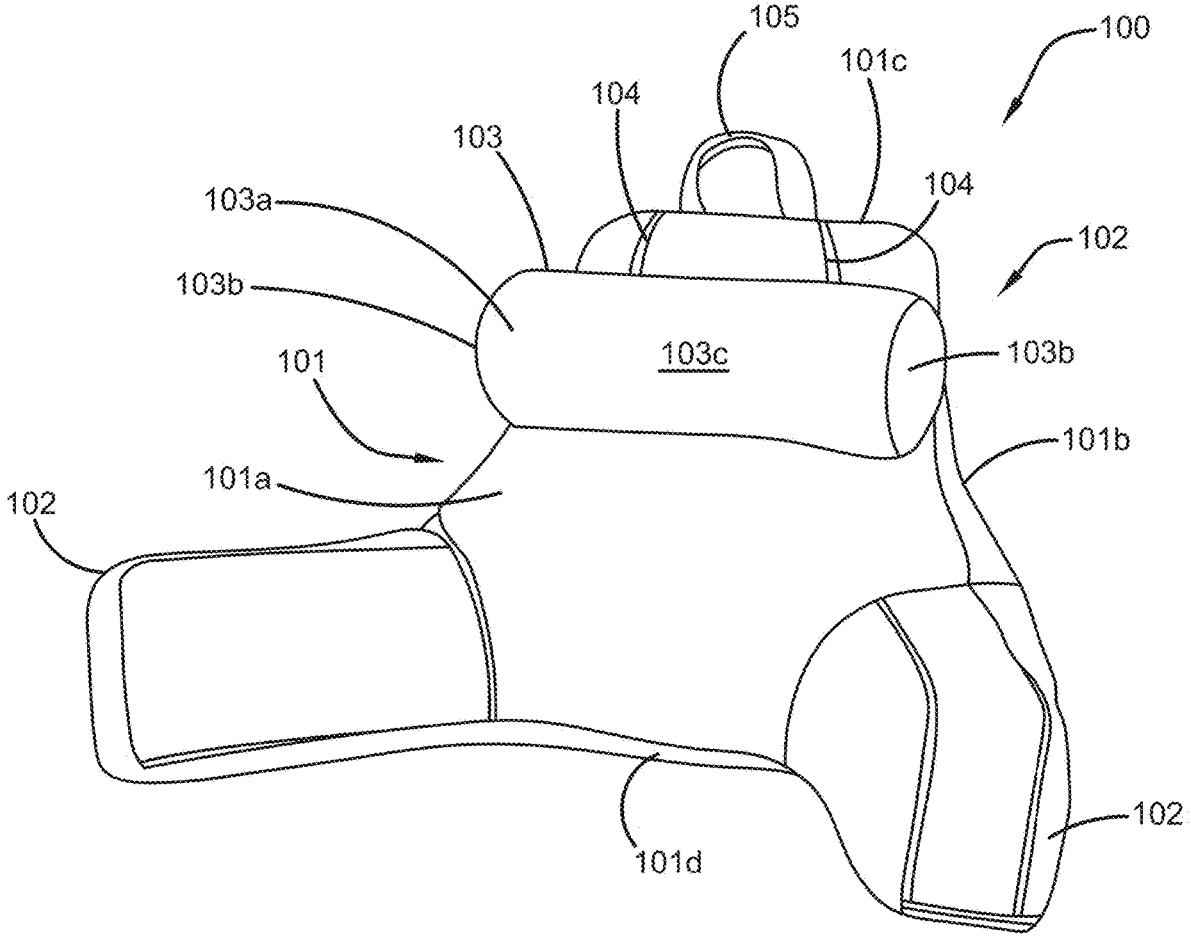
FIG. 13 is a front perspective view of the pillow with the neck support member positioned downwardly in a first position from that shown in FIG. 9.
Figure 14:
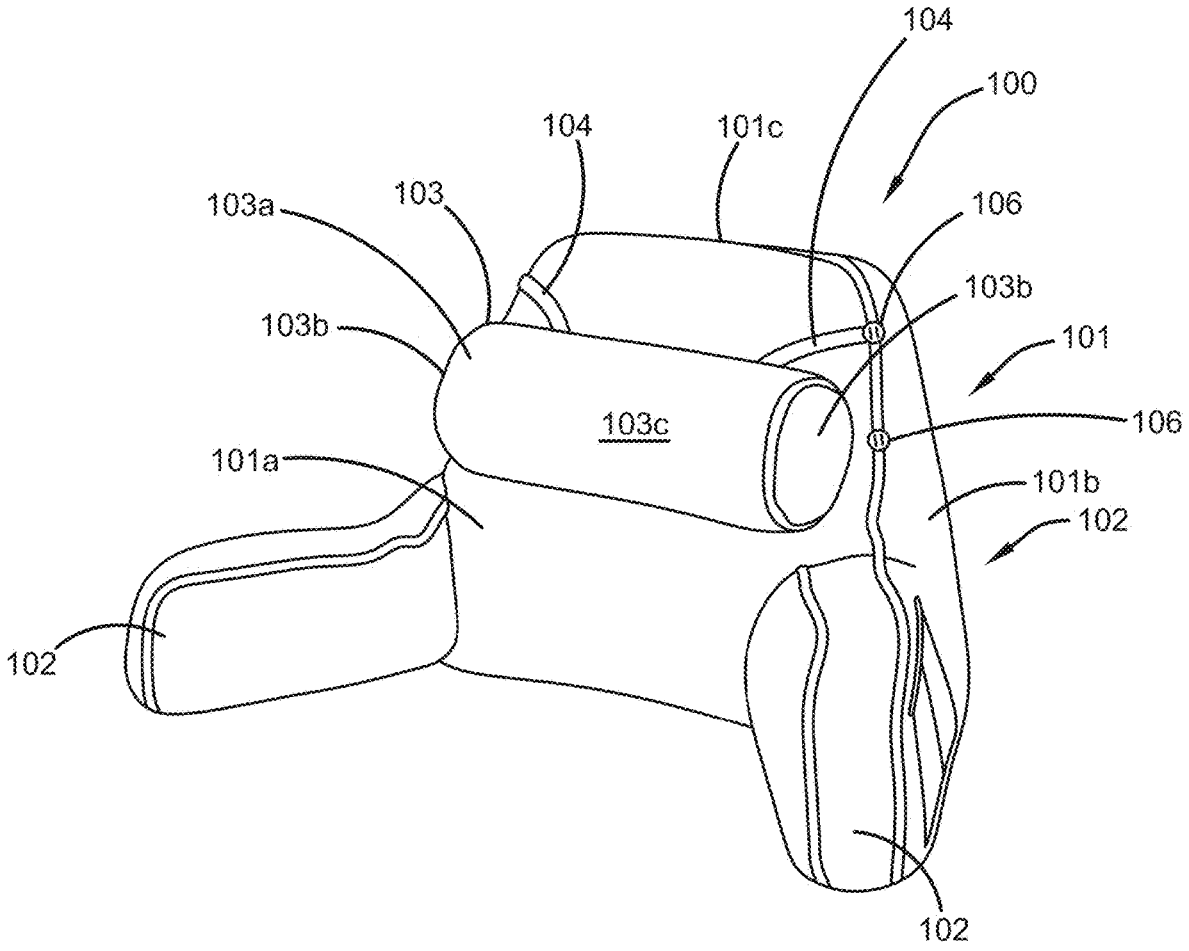
FIG. 14 is a front perspective view of the pillow with the neck support member positioned downwardly in a second position from that shown in FIG. 9.
Figure 15:
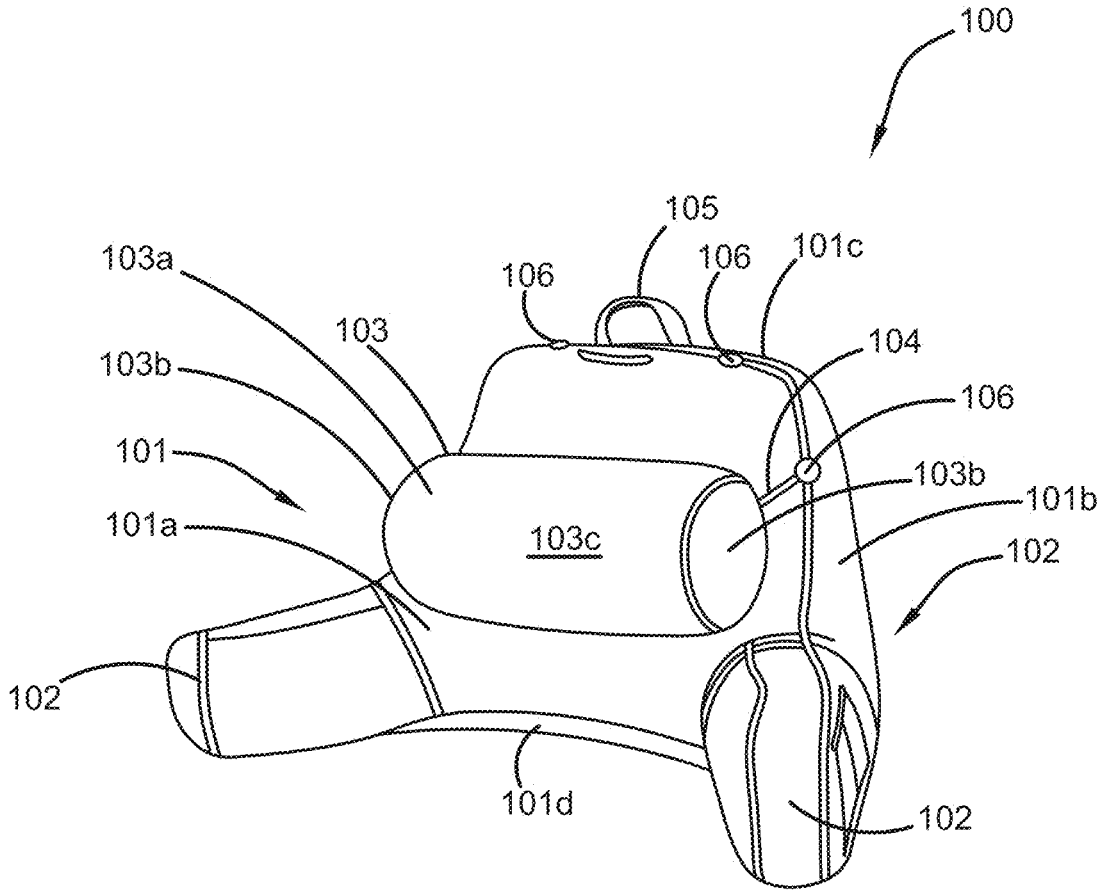
FIG. 15 is a front perspective view of the pillow with the neck support member positioned downwardly in a third position from that shown in FIG. 9.

As illustrated in FIG. 13, the neck support member 103 is adjusted relative to the top surface 101*c* of the central support pillow 101 and positioned downwardly in a first position from that shown in FIG. 9. As illustrated in FIG. 14, the neck support member 103 is adjusted relative to the top surface 101*c* of the central support pillow 101 and positioned downwardly in a second position from that shown in FIG. 9. As illustrated in FIG. 15, the neck support member 103 is adjusted relative to the top surface 101*c* of the central support pillow 101 and positioned downwardly in a third position from that shown in FIG. 9. It should be appreciated that the neck support member 103 may be adjusted to other positions relative to the top surface 101*c* of the central support pillow 101 than that illustrated.

Figure 16:
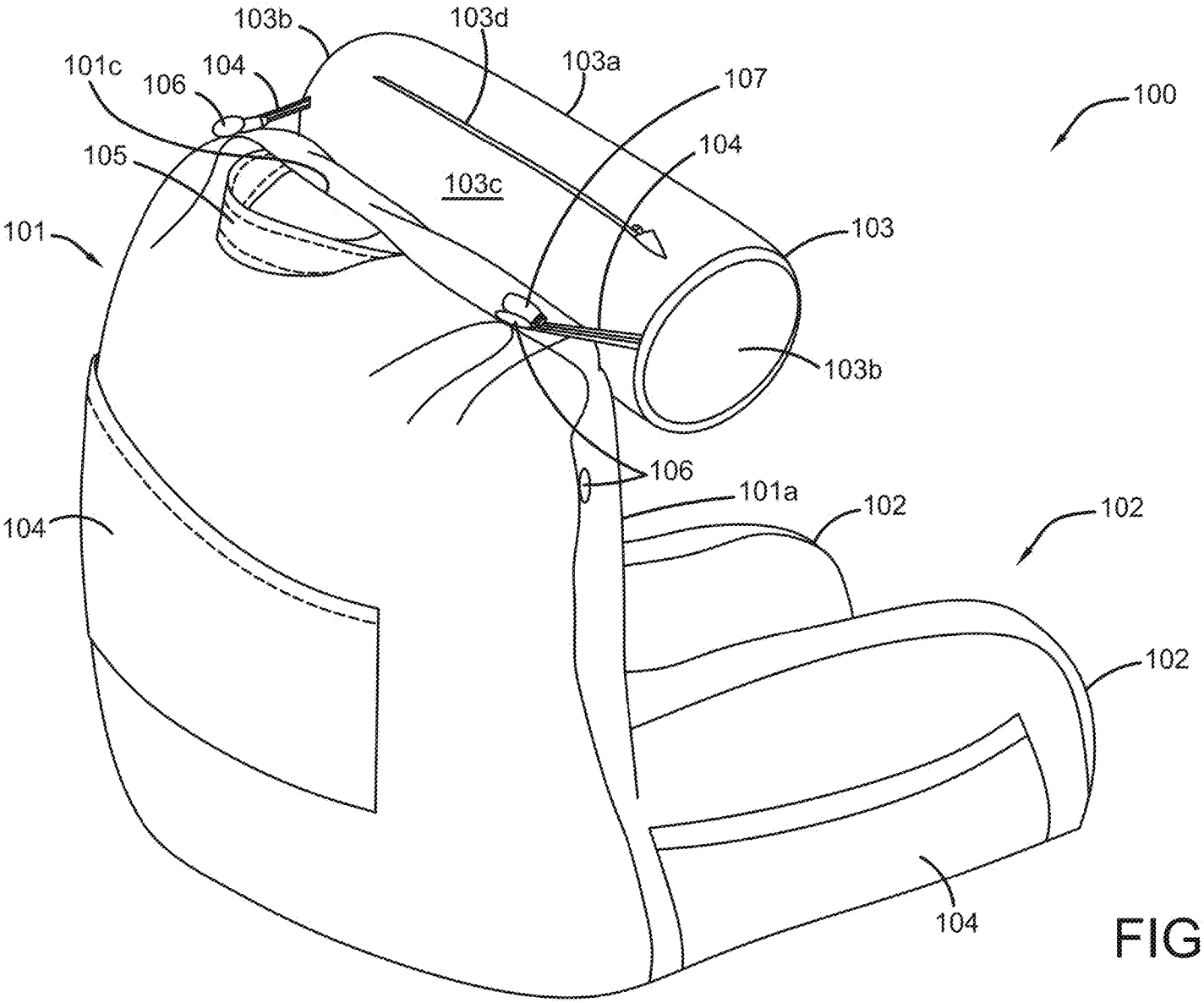
FIG. 16 is an enlarged rear perspective view of the pillow with the neck support member in a position from that shown in FIG. 9.
Figure 17:
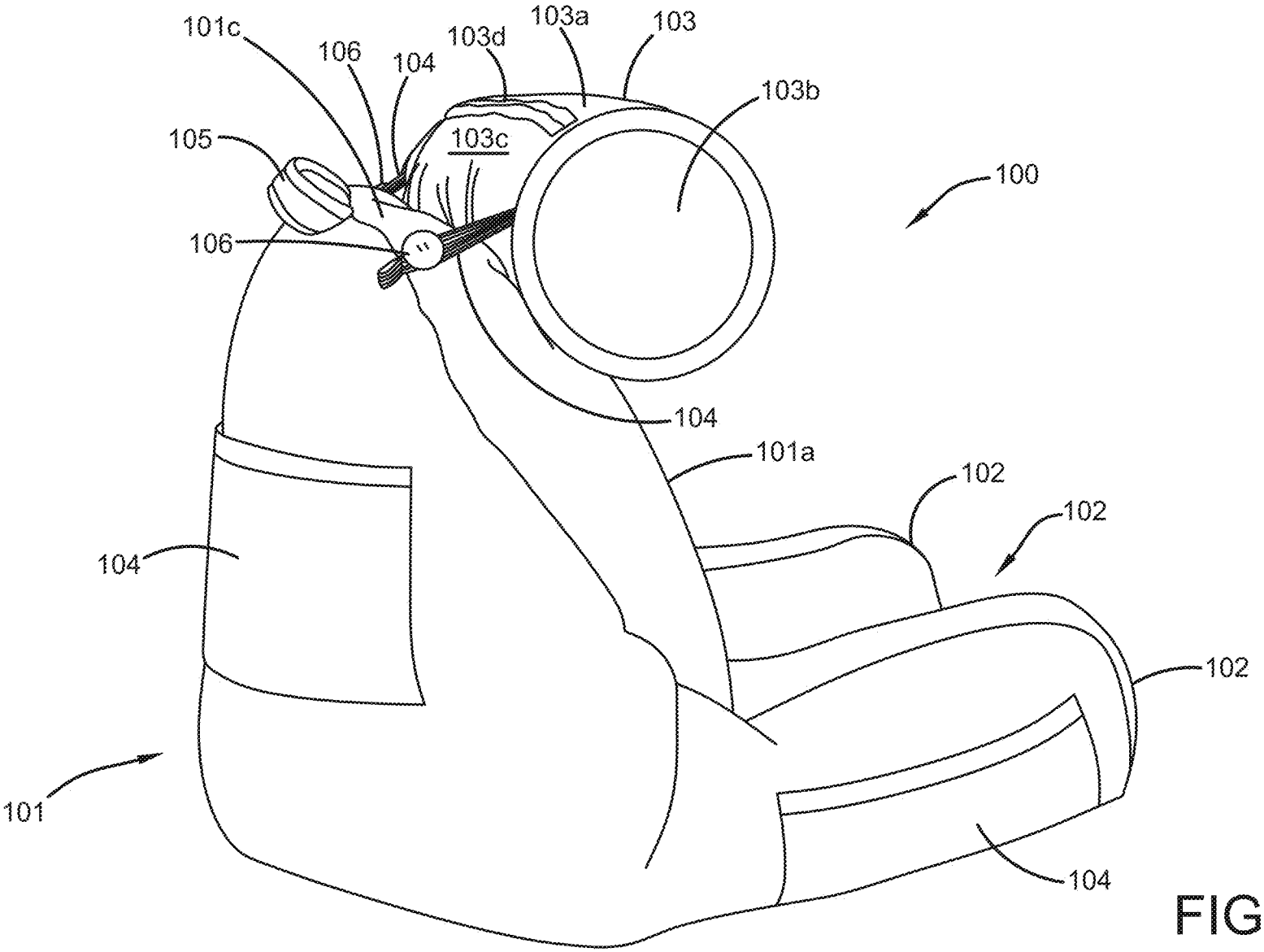
FIG. 17 is an enlarged side perspective view of the pillow with the neck support member in a position from that shown in FIG. 9.
Figure 18:
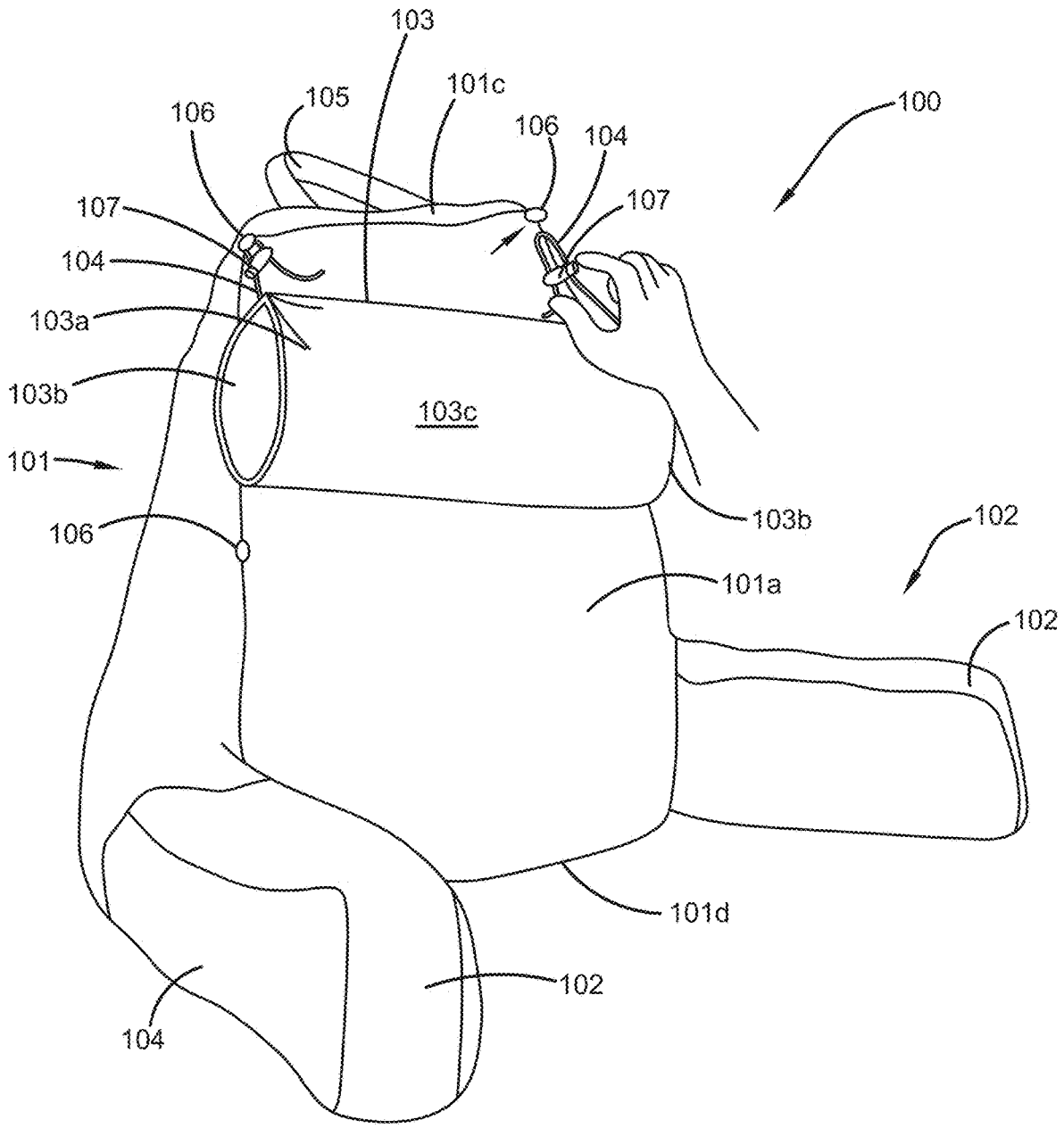
FIG. 18 is an enlarged front perspective view of the pillow with the neck support member being adjusted in a position by a hand of a human operator.

Referring to FIGS. 14-18, the pillow 100 includes one or more anchors 106 at fixed positions on the central support pillow 101. In one embodiment, the anchors 106 may be a button attached by a suitable mechanism such as stitching to the central support pillow 100. As illustrated in FIG. 14, the anchors 106 are at fixed positions along a seam of the central support pillow 101. As illustrated in FIG. 15, the anchors 106 are at fixed positions along the top surface 101 and a side surface of the central support pillow 101. As illustrated in FIG. 16, the attachment members 104 are attached to the anchors 106 by looping around the anchors 106. In one embodiment, the pillow 100 may include an adjuster 107 on the attachment member 104 to allow an adjustable length of the attachment member 104. As illustrated in FIG. 17, the attachment member 104 may be fixed in length by a suitable mechanism such as stitching such that the end of the attachment member 104 extends beyond the anchor 106. As illustrated in FIG. 18, the attachment member 104 may extend through the adjustor 107 and a hand of a human operator may be used to compress the adjustor 107 and allow the length of the attachment member 104 to be adjusted to remove or apply the attachment member 104 about the anchor 106. It should be appreciated that when the adjustor 107 is released by the hand of the human operator the length of the attachment member 104 is fixed.

The foregoing examples have been provided merely for the purpose of explanation and are in no way to be construed as limiting of the integrated pillow 100, disclosed herein. While the integrated pillow 100 has been described with reference to various embodiments, it is understood that the words, which have been used herein, are words of description and illustration, rather than words of limitation. Further, although the integrated pillow 100 has been described herein with reference to particular means, materials, and embodiments, the integrated pillow 100 is not intended to be limited to the particulars disclosed herein; rather, the integrated pillow 100 extends to all functionally equivalent structures, methods and uses, such as are within the scope of the present invention. Although there has been shown and described the preferred embodiment of the present invention, it will be readily apparent to those skilled in the art that modifications may be made there.

What is claimed is:

1. A pillow for ergonomically supporting a user comprising:

a central supporting pillow;

an adjustable neck support member having an outer surface; and a bungee cord attached to the neck support member and the central support pillow, wherein the neck support member is freely adjustable and detachably attached using the bungee cord, the bungee cord having one end attached to a top surface of the central supporting pillow and another end attached to the outer surface of the adjustable neck support member to ergonomically support a back and a neck of the user.

2. The pillow as set forth in claim 1, wherein the neck support member is a cylinder.

3. The pillow as set forth in claim 2, wherein the cylinder is a solid consisting of two parallel planes bounded by identical closed curves.

4. The pillow as claimed in claim 1, including at least one storage compartment on an exterior of the central supporting pillow to allow temporary storage of one or more objects.

5. The pillow as claimed in claim 1, wherein an exterior of the central supporting pillow and the neck support member is made of natural or synthetic fiber comprising one of polyester, rubber, cotton, and leather.

6. The pillow as set forth in claim 1 wherein the adjustable neck support member is at least partially arcuate in shape.

7. The pillow as set forth in claim 6 including an adjuster on the bungee cord to allow an adjustable length of the bungee cord.

8. The pillow as set forth in claim 7 wherein the bungee cord is fixed in length such that the end of the bungee cord extends beyond the anchors.

9. The pillow as set forth in claim 1 wherein the adjustable neck support member is at least semi-cylindrical in shape.

10. The pillow as set forth in claim 1 including one or more anchors at fixed positions on the central support pillow.

11. The pillow as set forth in claim 10 wherein the anchors are a button attached to the central support pillow.

12. The pillow as set forth in claim 10 wherein the anchors are at fixed positions along a seam of the central support pillow.

13. The pillow as set forth in claim 10 wherein the anchors are at fixed positions along the top surface and a side surface of the central support pillow.

14. The pillow as set forth in claim 10 wherein the bungee cord is attached to the anchors by looping around the anchors.

15. A pillow for ergonomically supporting a user comprising:

a central supporting pillow having at least two arm support members extending from the central supporting pillow;

an adjustable neck support member having an outer surface; and a bungee cord attached to the neck support member and the central support pillow, wherein the neck support member is freely adjustable and detachably attached using the bungee cord, the bungee cord having one end attached to a top surface of the central supporting pillow and another end attached to the outer surface of the adjustable neck support member to ergonomically support a back and a neck of the user.

16. The pillow as set forth in claim 15, wherein the neck support member is a cylinder.

17. The pillow as set forth in claim 16, wherein the cylinder is a solid consisting of two parallel planes bounded by identical closed curves.

18. The pillow as claimed in claim 15, including at least one storage compartment on either one of an exterior of the at least two arm support members and a rear of the central supporting pillow to allow temporary storage of one or more objects.

19. The pillow as claimed in claim 15, wherein an exterior of the central supporting pillow, the at least two arm support members, and the neck support member is made of natural or synthetic fiber comprising one of polyester, rubber, cotton, and leather.

20. A pillow for ergonomically supporting a user comprising:

a central supporting pillow;

an adjustable neck support member being a cylinder with opposing end portions; and a bungee cord attached to the neck support member and the central support pillow, wherein the neck support member is freely adjustable and detachably attached using the bungee cord, the bungee cord having one end attached to a top surface of the central supporting pillow and another end attached to the cylindrical portion of the adjustable neck support member to ergonomically support a back and a neck of the user.

21. The pillow as claimed in claim 20, including at least one storage compartment on an exterior of the central supporting pillow to allow temporary storage of one or more objects.

22. The pillow as claimed in claim 20, wherein an exterior of the central supporting pillow and the neck support member is made of natural or synthetic fiber comprising one of polyester, rubber, cotton, and leather.

23. A support pillow for ergonomically supporting a user comprising:

a central support pillow, at least two arm support members, and a neck support member, the central support pillow comprising a front surface, a rear surface, a top surface, and a bottom surface;

the front surface of the central support pillow being configured to contact a back of the user and conform to the back of the user;

the two arm support members extending outward from the front surface of the central support pillow and the at least two arm support members are positioned proximal to the bottom surface of the central support pillow to support arms of the user; and a bungee cord having one end attached to the neck support member and another end detachably attached to the top surface of the central support pillow, wherein the neck support member is freely adjustable and detachably attached using the bungee cord relative to a top surface of the central supporting pillow to ergonomically support a neck of the user.

24. The support pillow as set forth in claim 23, wherein the neck support member is a cylinder with opposing end portions.

25. The support pillow as set forth in claim 23 wherein an exterior of the central support pillow, the at least two arm support members, and the neck support member is made of a natural or synthetic fiber comprising one of polyester, rubber, cotton, and leather.

26. The support pillow as set forth in claim 23 wherein an interior of the central support pillow, the at least two arm support members, and the neck support member are made of filler materials comprising one of foam, cotton, poly-fill, memory foam, and Styrofoam beads.

27. The support pillow as set forth in claim 23 wherein the at least two arm support members are positioned at an angle of 90-120 degrees relative to the central support pillow.

28. The support pillow as set forth in claim 23 including at least one storage compartment configured on at least one of the rear surface of the central support pillow and outer surfaces of the at least two arm support members.

29. The support pillow as set forth in claim 28 wherein the at least one storage compartment comprises one of open pouches, pockets, and sealable compartments having zip fasteners to seal the at least one storage compartment.

* * * * *